US006337570B1

(12) United States Patent
Audren et al.

(10) Patent No.: US 6,337,570 B1
(45) Date of Patent: Jan. 8, 2002

(54) CURRENT LOOP COMPRISING A TEST CIRCUIT

(75) Inventors: Jean-Paul Audren; Jean Marmonier, both of Aix les Bains (FR)

(73) Assignee: Alstom Holdings, Paris (FR)

( * ) Notice: Subject to any disclaimer, the term of this patent is extended or adjusted under 35 U.S.C. 154(b) by 0 days.

(21) Appl. No.: 09/508,760

(22) PCT Filed: Jul. 19, 1999

(86) PCT No.: PCT/FR99/01764

§ 371 Date: Mar. 16, 2000

§ 102(e) Date: Mar. 16, 2000

(87) PCT Pub. No.: WO00/05695

PCT Pub. Date: Feb. 3, 2000

(30) Foreign Application Priority Data

Jul. 20, 1998 (FR) ..... 98 09217

(51) Int. Cl.[7] ..... H01H 31/02; H01H 31/12; G08C 15/08; G08B 29/00

(52) U.S. Cl. ..... 324/541; 324/544; 324/551; 340/870.13; 340/508; 340/661

(58) Field of Search ..... 324/541, 544, 324/551; 340/870.13, 508, 509, 510, 511, 661–664; 327/512

(56) References Cited

U.S. PATENT DOCUMENTS 3,829,886 A * 8/1974 Kroger ..... 327/512
4,213,180 A * 7/1980 Marchak et al. ..... 701/114
4,607,247 A * 8/1986 Sterling, Jr. et al. .... 340/310.01
4,633,217 A * 12/1986 Kano ..... 340/310.05
4,634,981 A * 1/1987 Shimp et al. ..... 324/424
4,737,787 A * 4/1988 Ito et al. ..... 340/870.18
5,402,040 A * 3/1995 Sprout ..... 315/157
5,471,144 A * 11/1995 Meyer ..... 324/551
5,563,587 A * 10/1996 Harjani ..... 340/870.3
5,574,378 A * 11/1996 Meyer et al. ..... 324/541
5,640,085 A * 6/1997 Petr et al. ..... 324/105
6,104,791 A * 6/1998 Gizara et al. ..... 379/93.28
5,805,062 A * 9/1998 Pearlman ..... 340/508
6,102,340 A * 8/2000 Peek et al. ..... 246/121

FOREIGN PATENT DOCUMENTS

EP 0 422 663 A2 * 4/1991

* cited by examiner

*Primary Examiner*—Glenn W. Brown
*Assistant Examiner*—Wasseem H. Hamdan
(74) *Attorney, Agent, or Firm*—Sughrue Mion, PLLC

(57) ABSTRACT

The 4 mA–20 mA type or 0–20 mA type current loop connects an analog sensor (1) to an acquisition system (3), respectively carrying a sensor current (Ic) and an acquisition current (Ia). A test circuit is connected in parallel with the current loop to inject a superposition current (Is) into said loop, which current is superposed on the sensor current (Ic) or on the acquisition current (Ia). In a first embodiment, a variable voltage generator (7) injects the superposition current (Is) by adding it to the acquisition current (Ia), thereby making it possible to check a low-current threshold of the acquisition system (3). In a second embodiment, a variable current regulator injects the superposition current (Is) by adding it to the sensor current (Ic), thereby making it possible to check a high-current threshold of the acquisition system. The high- and low-current thresholds of the acquisition system are tested without opening the current loop.

10 Claims, 3 Drawing Sheets

CURRENT LOOP COMPRISING A TEST CIRCUIT

BACKGROUND OF THE INVENTION

The invention relates to a current loop of the 4 mA –20 mA or of the 0–20 mA type, connecting an analog sensor to an acquisition system respectively carrying a senor current and an acquisition current.

Such current loops are in widespread use. The 4 mA –20 mA type loop, e.g. made of "2 $\mu$Is" technology enables the sensor to operate using the energy supplied by a 4 mA sensor current. The advantages of a current loop are well known: firstly the power supply for the sensor is carried by the same wires as the signal, thereby reducing the cost of cabling compared with other types of signal that would require additional wires in the cable, and secondly the signal is disturbed to a very small extent by electromagnetic radiation, thereby enabling it to be conveyed over long distances or through surroundings having high radiation density.

In known manner, proper operation of the acquisition system is monitored by means of test devices designed to simulate the operation of the sensor. Simulation is performed by connecting the test device so that it takes the place of the analog sensor. Nevertheless, there are drawbacks in disconnecting the sensor: there is a risk of it being wrongly reconnected, e.g. by reversing its polarity, or even that reconnection will be forgotten, or perhaps that the connections will be left too loose. Under such conditions, maintenance of the acquisition system turns out to be counterproductive.

Also in known manner, the operation of the analog sensor is monitored by disconnecting the current loop. This is done, in particular, when the sensor is removed from its installation site. In that case also, disconnection is not without its drawbacks: as a general rule, the acquisition system interprets the open loop as being anomalous and generates an alarm. It is therefore necessary to take action to prevent the anomaly being treated as such by a unit that controls the acquisition system.

SUMMARY OF THE INVENTION

The object of the invention is to remedy the problem of monitoring the operation of an acquisition system or of a sensor by disconnection and reconnection in a current loop of the 4 mA–20 mA type or of the 0–20 mA type.

The invention is based on the idea of inspecting the current loop without opening it.

To this end, the invention provides a current loop of the 4 mA–20 mA type or of the 0–20 mA type, connecting an analog sensor to an acquisition system respectively carrying a sensor current and an acquisition current, the loop being characterized in that a test circuit is connected in parallel with the current loop to inject a superposition current into said loop, which current is superposed on the sensor current or the acquisition current.

The superposition current injected into the current loop by the test circuit is superposed on the current carried by the sensor to simulate its operation relative to the acquisition system, or it is superposed on the current passing through the acquisition system to simulate its operation relative to the analog sensor.

The test circuit connected in parallel with the current loop thus serves to inject a superposition current without opening the current loop connecting the acquisition system to the analog sensor. This remedies the drawbacks mentioned above: firstly the risk of the sensor being reconnected with reverse polarity is eliminated, and secondly no open loop anomaly is detected by the acquisition while the analog sensor is being tested.

According to a first advantage of the invention, the test circuit comprises a variable voltage generator connected in parallel with the acquisition system to inject the superposition current by adding it to the acquisition current, thereby making it possible to monitor a low-current threshold of the acquisition system.

In a preferred embodiment, the test circuit includes an ammeter connected in series with the variable DC voltage generator to determine the magnitude of the superposition current.

In another preferred embodiment, the test circuit includes a diode connected in series with the variable voltage generator to protect the current loop when the variable voltage is zero.

In another preferred embodiment, the test circuit includes a diode connected in series with the acquisition system to preserve operating independence of a plurality of current loops connecting a plurality of sensors to a common acquisition system.

According to a second advantage of the invention, the test circuit includes a variable current regulator connected in parallel with the analog sensor to inject the superposition current by being added to the sensor current, thereby making it possible to monitor a high-current threshold of the acquisition system.

According to a third advantage of the invention, the test current includes a variable current regulator connected in parallel with the analog sensor to inject the superposition current by adding it to the sensor current, the superposition current being servo-controlled to said sensor current, thereby making it possible to maintain the acquisition current in the current loop.

In a preferred embodiment, the test circuit includes an ammeter connected in series with the variable current regulator to determine the magnitude of the simulation current.

BRIEF DESCRIPTION OF THE DRAWINGS

Other characteristics and advantages of the invention will appear on reading the following description of embodiments as illustrated by the drawings.

Figure 1:
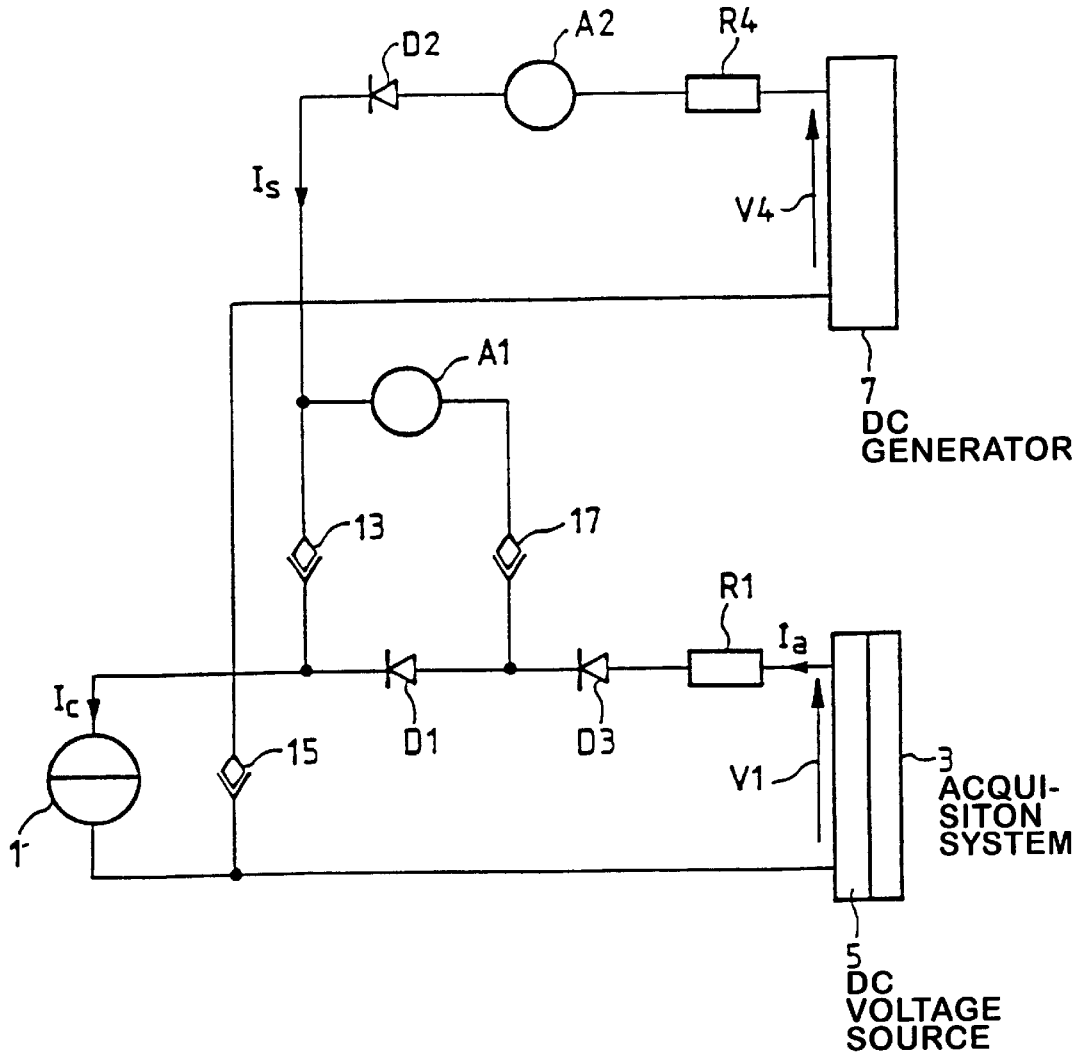
FIG. 1 is an electrical circuit diagram of a current loop with an analog sensor and an acquisition system, together with a test circuit connected in parallel to test the low-current threshold of the acquisition system.

A 4 mA–20 mA type current loop as shown in FIG. 1 comprises an analog sensor 1 and an acquisition system 3. By way of example, the analog sensor is a pressure sensor mounted on the outside of the casing of a high voltage electrical apparatus such as a circuit breaker. Nevertheless, it is clear that the invention is not limited to such a pressure sensor, and it applies to other analog sensors operating in a 0–20 mA or a 4 mA–20 mA current loop. By way of example, such sensors include temperature sensors, flow rate sensors, pH sensors, and indeed viscosity sensors.

The pressure sensor 1 has a sensor current Ic flowing therethrough, which current is determined by the pressure present inside the casing of a circuit breaker that is filled with an arc-distinguishing dielectric gas.

The acquisition system 3 comprises a DC voltage source 5, e.g. at 24 volts (V1). The voltage source delivers acquisition current Ia into a series resistor R1, e.g. having a resistance of 100 ohms (Ω). An ammeter A1 is temporarily connected in parallel with a diode D1 in series with the acquisition system 3 to determine the magnitude of the acquisition current Ia.

According to the invention, a test circuit is connected in parallel with the current loop to inject a superposition current into said loop, which current is superposed on the sensor current or on the acquisition current.

In a first embodiment of the invention, as shown in FIG. 1, the test circuit comprises a DC generator 7 generating a voltage V4 that can be varied over the range 0 to 24 V and that is connected in parallel with the acquisition system 3. The generator 7 delivers a superposition current Is into a series resistor R4 of resistance equal to 100 Ω, for example.

The superposition current Is is injected via the voltage generator 7 upstream from the pressure sensor 1 relative to the flow direction of the acquisition current Ia so as to be added thereto, with the sum Ia+Is being equal to the sensor current Ic. An ammeter A2 is connected in series with the variable DC voltage generator 7 to determine the magnitude of the superposition current Is.

In this way, the variable voltage V4 is increased progressively so as to increase the superposition current Is and so as to decrease the acquisition current Ia, given that, while the test is taking place, the sensor current Ic as imposed by the constant pressure inside the casing, itself remains constant. This thus causes the acquisition current Ia to be lowered to a low threshold so as to verify that the acquisition system is operating properly without opening the current loop.

The test circuit as shown in FIG. 1 preferably comprises a diode D2 connected in series with the variable voltage generator to prevent part of the acquisition current Ia being diverted into the test circuit when the variable voltage V4 is small.

Provision is also made to connect a diode D3 in series with the DC voltage source 5 of the acquisition system 3 so as to deal with an increase in said voltage V1, since the current Ia must not become negative. In this way, the possibility of feeding a plurality of pressure sensors in a plurality of current loops from the same DC source is maintained and it continues to be possible to maintain the low acquisition current threshold of a current loop without disturbing feed to other pressure sensors in other current loops.

Figure 2:
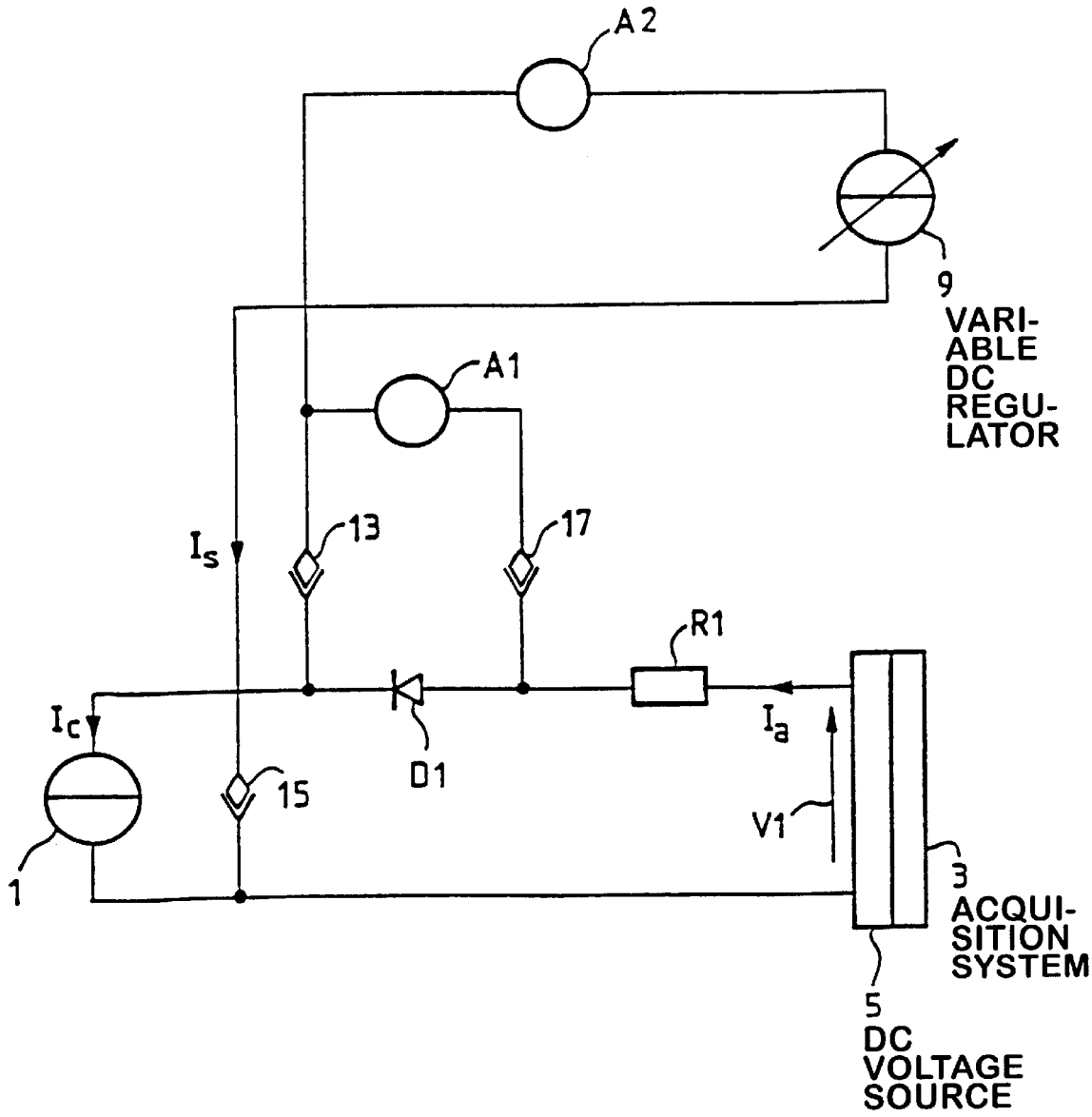
FIG. 2 is an electrical circuit diagram of a current loop with an analog sensor and an acquisition system, together with a test circuit connected in parallel to test the high-current threshold of the acquisition system.

In a second embodiment, as shown in FIG. 2, the test circuit comprises a variable DC current regulator 9 connected in parallel with the analog sensor 1.

The superposition current Is is injected via the variable DC regulator 9 downstream from the pressure sensor 1 relative to the direction of the acquisition current Ia so as to be added to the sensor current Ic, with the sum Ic+Is being equal to the acquisition current Ia. An ammeter A2 is connected in series with the variable DC regulator 9 to determine the magnitude of the superposition current Is.

In this way, the superposition current Is is varied progressively so as to increase the acquisition current Ia given that the sensor current Ic as imposed by the constant pressure inside the casing throughout the duration of the test remains constant. This causes the acquisition current Ia to increase to a high threshold to verify proper operation of the acquisition system 3 without opening the current loop.

It should be observed, advantageously, that while testing the low and high-current thresholds of the acquisition system, the sensor current Ic can be determined from the magnitudes of the acquisition current Ia and of the superposition current Is as determined by the ammeters A1 and A2 connected in the test circuit. As a result, the pressure of the dielectric gas contained in the casing is monitored throughout the entire duration of the test being applied to the thresholds of the acquisition system by means of a test circuit connected in parallel with the current loop. A leak of dielectric gas from the casing would give rise to a drop in the sensor current Ic and consequently to a drop in the superposition current Is which can easily be determined by the ammeter A2.

Figure 3:
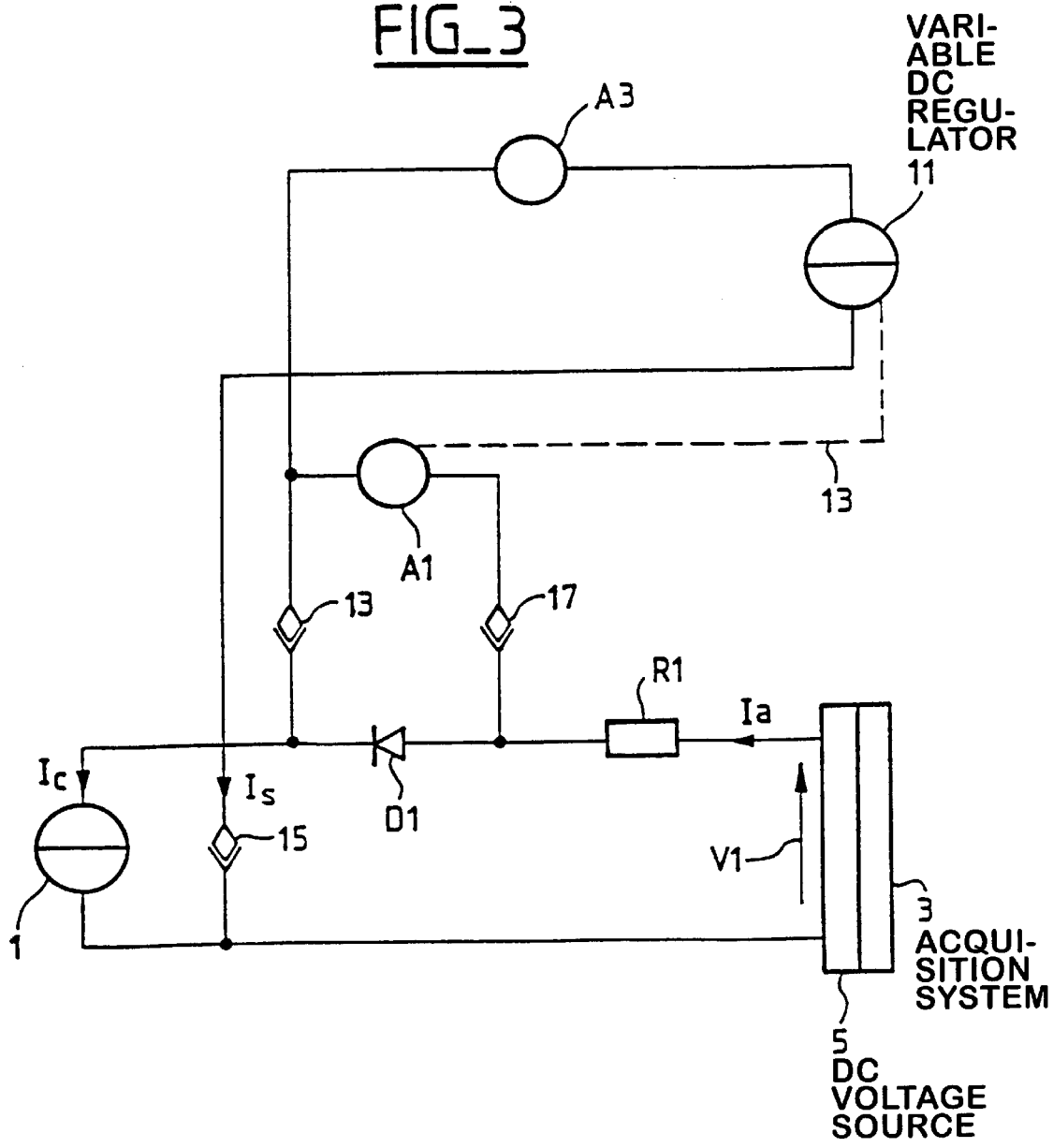
FIG. 3 is an electrical circuit diagram of a current loop with an analog sensor and an acquisition system, together with a test circuit connected in parallel to keep an acquisition current constant regardless of a sensor current.

In a third embodiment of the invention, as shown in FIG. 3, the test circuit comprises a variable current regulator 11 connected in parallel with the pressure sensor 1 to inject a superposition current Is by being added to the sensor current Ic, the superposition current Is being servo-controlled to the acquisition current Ia.

The magnitude of the acquisition current Ia as acquired by the acquisition system at the beginning of the test is given as a reference to the variable DC regulator 11 by a servo-control system 13 connected to the ammeter A1 connected in parallel with the series diode D1 of the acquisition system 3.

Throughout the duration of the test, any variation in the sensor current Ic gives rise to a variation in the acquisition current Ia which is immediately compensated by the superposition current Is injected by the regulator 11 to keep the acquisition current Ia constant. If the sensor current Ic drops, the superposition current Is increases to keep it constant.

In this way, the sensor current Ic is progressively decreased and replaced by the superposition current Is without opening said current loop. When Ic is zero, the pressure sensor 1 can be disconnected from the current loop to inspect it while avoiding any open loop anomaly being detected by the acquisition current. No alarm is generated by the acquisition system.

In a fourth embodiment of the invention, the test circuit is installed in a portable and removable box which has connection terminals for connection to test points permanently mounted on the current loop.

One of the connection terminals 13 is connected downstream from the diode D1 connected in series with the acquisition system at a point common with the ammeter A1 that measures the magnitude of the acquisition current Ia. The other connection terminal 15 is connected downstream from the pressure sensor 1. The ammeter A1 is preferably integrated in the test box, which in this case has a third terminal 17 connected upstream from the diode D1 in a connection that is common with the ammeter.

What is claimed is:

1. A current loop for connecting an analog sensor (1) having a sensor current (Ic) flowing therethrough to an acquisition system (3) which generates an acquisition current (Ia), the current loop comprising a test circuit for testing operation of the acquisition system, said test circuit being connected in parallel with the current loop for providing to the current loop a superposition current (Is) which is superposed on the sensor current (Ic) or on the acquisition current (Ia), and progressively increasing the superposition current (Is) to verify a low-current threshold of the acquisition system or a high-current threshold of the acquisition system.

2. The current loop according to claim 1, wherein the test circuit includes a variable voltage generator (7) connected in parallel with the acquisition system (3) for providing to the current loop the superposition current (Is) to maintain the sum of the acquisition current (Ia) plus the superposition current at a constant level while the superposition current is being increased, which sum corresponds to the sensor current (Ic), so as to verify the acquisition system down to a low-current threshold.

3. The current loop according to claim 2, wherein the test circuit includes a diode (D2) connected in series with the variable voltage generator (7).

4. The current loop according to claim 2, wherein the test circuit includes a diode (D3) connected in series with the acquisition system.

5. The current loop according to claim 2, wherein the test circuit includes an ammeter (A2) connected in series with the variable voltage generator (7).

6. The current loop according to claim 1, wherein the test circuit includes a variable current regulator (9) which is connected in parallel with the analog sensor (1) for providing to the current loop the superposition current (Is) to maintain the sum of the sensor current (Ic) plus the superposition current at a constant level while the superposition current is increased, which sum corresponds to the acquisition current, so as to verify the operation of the acquisition system up to a high-current threshold.

7. The current loop according to claim 6, wherein the test circuit includes an ammeter (A2) connected in series with the variable current regulator (9).

8. The current loop according to claim 6, wherein the current regulator (9) is servo-controlled to the acquisition current (Ia).

9. The current loop according to claim 1, wherein the analog sensor is a pressure sensor for sensing the pressure in a casing of an electrical apparatus.

10. The current loop according to claim 1, further comprising a removable box for housing the test circuit, the removable box including connection terminals (13, 15, 17) for connection to test points permanently mounted in the current loop.

* * * * *